US008852013B2

(12) United States Patent
Taylor

(10) Patent No.: US 8,852,013 B2
(45) Date of Patent: Oct. 7, 2014

(54) GOLF SWING TRAINING DEVICE

(71) Applicant: Charles Fredrick Taylor, Citrus Heights, CA (US)

(72) Inventor: Charles Fredrick Taylor, Citrus Heights, CA (US)

( * ) Notice: Subject to any disclaimer, the term of this patent is extended or adjusted under 35 U.S.C. 154(b) by 0 days.

(21) Appl. No.: 13/733,113

(22) Filed: Jan. 2, 2013

(65) Prior Publication Data

US 2014/0187340 A1 Jul. 3, 2014

(51) Int. Cl.
*A63B 69/36* (2006.01)

(52) U.S. Cl.
CPC ..... *A63B 69/3608* (2013.01)
USPC ..... 473/208

(58) Field of Classification Search
USPC ..... 473/201, 205–208, 212, 215, 216, 473/226–229, 409
See application file for complete search history.

(56) References Cited

U.S. PATENT DOCUMENTS 1,962,256 A * 6/1934 Nelson et al. ..... 473/214
3,740,052 A * 6/1973 Arkin ..... 473/214
4,662,640 A * 5/1987 Grander ..... 473/215
5,149,099 A * 9/1992 Radakovich ..... 473/208
5,154,416 A * 10/1992 Smull et al. ..... 473/458
5,203,570 A * 4/1993 Graham ..... 473/214
5,688,184 A * 11/1997 Johnson ..... 473/229
5,893,803 A * 4/1999 Leadbetter et al. ..... 473/206
6,783,464 B1 * 8/2004 Romano ..... 473/208

* cited by examiner

*Primary Examiner* — Nini Legesse

(57) ABSTRACT

A golf swing training device teaches proper golf swing. The present invention comprises a golf club with attached elastic band loop. An aspect of the present invention is the elastic band/golf club connection located at the mid longitudinal section of the golf club grip. In use, the player loops the elastic band over his/her head. The elastic band left side rests on the left shoulder; elastic band right side rests on the right shoulder. The player grasps the present invention by placing the right and left hands on the golf club with forefingers and thumbs between the elastic band distal ends. This teaches proper alignment of the hands. The player takes set-up position with out-stretched arms creating resistance forces through the arms provided by the elastic band. A collapse in either elbow will result in resistance loss and noticeable elastic band sag. Re-enforce good habits through drills, intermediate, or, unrestricted full-swing ball contact at the practice range. The present invention incorporates adjustability in resistance and dimensions to accommodate golfers of different body types and sizes.

1 Claim, 5 Drawing Sheets

GOLF SWING TRAINING DEVICE

RELATED APPLICATIONS

Not Applicable

BACKGROUND OF THE INVENTION

The present invention relates to swing training devices used in the field of golf.

Years of exposure to the game of GOLF have lead to examination of the fundamental mechanics that must take place in a golf swing to produce a desired outcome with a high percentage of consistency. In the profession of GOLF, commonly noted documentation exists of early stage back swing mechanics relative to the proper wrist hinging position located approximately during the half way back stage and pertinent to proper swing plane golf.

For example: Nick Faldo writes in Golf Today Newsletter, (http://www.golftoday.co.uk/proshop/features/how_to_plug_in_a_repeating_swing.html), "How to plug in a repeating swing." "For the better part of 20 years, ever since the reconstruction of my swing in the mid-1980s, I have focused on this halfway-back position via what's become known as an 'early wrist set'. It's quite simple: I look for my wrists to be fully hinged and the club 'set' up on a good plane by the time my left arm is at horizontal."

"From here, the swing is pretty well plugged in" (Faldo).

"The beauty of working on this halfway-back position is that all the details of a technically sound swing are encapsulated within it: you have a full wrist hinge, the club is swinging up on plane, and you maintain good body angles. Completing your shoulder turn gets you to the top, whereupon unwinding the body invites the hands and arms into the perfect hitting position" (Faldo).

Problems that occur while trying to duplicate the proper "halfway-back" swing position are trying to train the eyes, muscles, and brain to react to what you perceive as reproducing the proper mechanical moves.

While golf teaching professionals are great for identifying swing problems verbally, most students of the game cannot carry out what is conveyed to them because they can't see the before or after in order to make reliable corrections. For example, to be told that at the top of ones swing, one did not have the club face properly positioned in relationship to ones spine and chosen target line due to the collapse of ones wrist coupled with the collapse of ones elbow during the "halfway-back" point of the back-swing is unimaginable to absorb, forbid carrying out the change next time because there's nothing to compare with.

There is little replacement for repetition to establish good "muscle memory" while training in the sport of golf; however, golf swings are habit forming and once established are very difficult to correct if needed. For example: a multitude of people know who Charles Barkley is mostly for his outstanding basket ball career and others relate him to his past appearance on the TV show, "The Haney Project." Most would agree that Hank Haney, the number 1 golf instructor in the World, had his hands full to correct the infamous hitch Charles developed over the years of repeating golf swing habits that are considered non conforming to good golf mechanics theory.

The Brain; thousands of practice balls, one after another and as fast as you can empty the bucket, you find yourself frustrated because that new move is not working like it did during lesson day with the golf pro. The problem is that most students of the game try to process multiple changes all at once, why not; it worked when the instructor was present. It works to some degree because the golf instructor is constantly fixing the problems that the new move has created thus eventually, bang, it's on. An hour later when the lesson is over, multiple new myelin changes have violated your neural circuits taking up battle with old habits and it seems the only way to fix it is with more lessons, $$$.

In Golf Magazine 50$^{th}$ Anniversary Issue, September 2009, Dr. Robert Christina, dean emeritus of the School of Health and Human Performance at UNC-Greensboro and Golf Magazine's learning expert in residence, writes; "The Problem." "You empty bucket after bucket on the range, but the new swing change you're trying to ingrain just won't stick. I fact, you find yourself repeating the fault you're trying to lose over and over." "The Solution." "When you practice, work on one change only, or you'll literally short-circuit your brain. Repeating a movement-like swinging a golf club-causes changes in your central nervous system that increase the efficiency of the brain circuits controlling the muscles involved." "One of these changes is myelination, the production of a fatty tissue called myelin around your neural circuits. Each time you use a circuit, this myelin cocoon gets thicker and increases the timing and speed of the signal traveling through the circuit, making it more efficient. Here's the problem: Myelin doesn't recognize a good golf move from a bad one. This means each lousy swing you make creates myelin and just makes that bad move easier to repeat, adding to the need to practice the right things. "The key," says Dr. Christina, "is to practice while someone qualified is watching you, or with drills or training aids that provide you with feedback to ensure that you are performing the skill correctly."

Its been observed recently that there is an enormous amount of focus on resilience training devices, a shift perhaps from the typical audio and digital training devices, which may be attributed to resistance bands having direct influence on trainable muscles with excellent efficiency. The present invention meets and exceeds Dr. Christina's' aforementioned suggestions because it uses all three: use with drills, visually, it's like having an instructor with you, and as a training aid, it provides excellent feedback through out the entire swing.

An over-whelming amount of golf swing training devices are available to the public that focus on parts of the golf swing and in whole but may not be practical or encapsulate what Dr. Christina suggests. For example, a strap that ties your arms together forming a V-shape to discourage disconnect of the major muscle groups during a swing. Another training device would be an elastic strap that is attached to a body part attached to a stationary object that focuses on a particular move or muscle group exercise. Another training device would be a golf club grip formed such that when grasped it aligns your hands in the proper grip position. Yet another, digital video recording software that allows one to view what one did right or wrong during his or her swing. And yet another, and another, and another, etc. . . . .

Given the enormous amount of golf training devices on the market today, the Annual Golf Participation reports (according to National Golf Foundation (NGF)) for 2011 was 25.7 million and an estimated growth for the U.S. in 2012 at 7.4%, and that the average amateur golfer scores 100 on a regulation course for 18 holes, one can deduce that a golf swing training device that comprises multi-learning techniques while maintaining as much as possible the natural characteristics of a playing golf club transferable to the golf course is desperately needed.

The uniqueness of the present invention incorporates a multitude of the aforementioned training techniques and necessities, namely visual aids, muscle memory, and confidence that, what is learned is reliable.

The present invention, a golf swing training device utilizable by a golfer comprising of: an elastic band at relaxed state forming a loop with a length relative to the golfer's size and having two distal ends; the first distal end of the elastic band is connected to the playing club component grip proximal to the butt end of the grip; the second distal end of the elastic loop is attached to the component grip located longitudinally linier from the first connection point proximal to the bore end of the component grip.

Connection points of the band to the golf component grip and the golfer play key role in the stability and performance of the present swing training device. The connection points also provide repeatable natural assistance to proper hand-to-grip position. By using a flat elastic resistance band, used in nearly every fitness center in the U.S., there is little noticeable friction while connection around the back neck during the swing.

While swinging the device, a visual aid is displayed via the stretched elastic band loop that runs parallel to the player's arms; the player can slow or stop his/her swing at any point in the swing for instant visual relationship feedback.

Furthermore, the present invention provides an elastic band loop capable of positioning it on the body in a multitude of different set ups to train while providing numerous visual and muscle memory feedback scenarios.

It is these connections, around the back of neck nearest the upper spine coupled with the connection at the golf swing device, that provide outstanding performance of the present swing training device.

BRIEF SUMMARY OF THE INVENTION

In general, the present invention golf swing training device is a tool to improve control, power, accuracy and distance long-term while executing an unrestricted golf swing.

Problems that occur while trying to execute the perfect swing are trying to train the eyes, muscles, and brain to react to what you perceive proper mechanical moves without costly inconsistent advice.

The present invention uses different types of learning techniques that promote long term memory, such as the coined Mechanically Assisted Muscle Memory (MAMM) in that strategically connected elastic bands actually help set the "halfway-back" position in the golf swing producing excellent stability and consistency with little effort and instant muscle feedback. If the elastic band is loose during the swing, the feel is obvious.

The present invention also uses the coined learning technique Simplified Visual Aid (SVA) in that a strategically connected elastic band is visual at any chosen point in the swing to compare the relationship with the arms, chest, and shoulders.

Some advantages with the present invention consist of, low cost to make therefore low cost for the consumer, replaces instruction and cost, use to train or practice round, wide range of swing stroke, flexible to training body groups, can be used for instruction, can be placed in a golf bag next to the other clubs, durable, adjustable to fit any body type and size, not weather dependant, can be installed on any golf club, helps proper set up, aligns hands on grip, although the assembled golf component grip is intended as a unit, it can be obtained separately and installed per component grip install procedure by any qualified club-maker, assembles to any standard tubular golf grip, quick and easy to use, no belts, no slings, no set-up, and esthetically professional to name a few. Most of all, the present invention golf swing training device works.

DETAILED DESCRIPTION OF THE INVENTION

Figure 1:
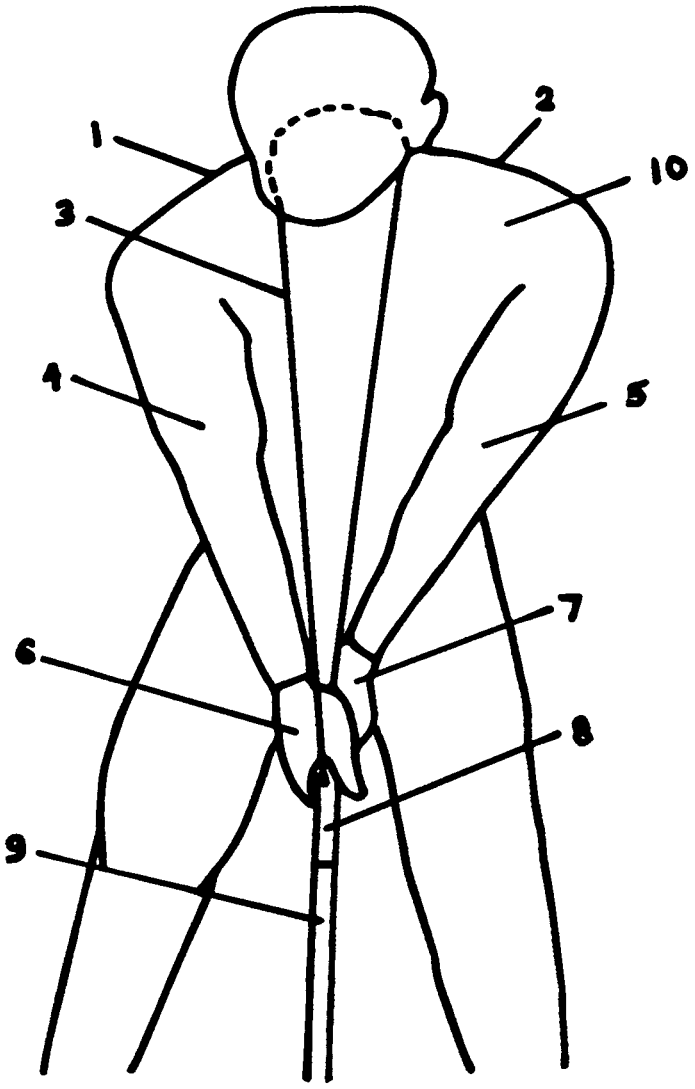
FIG. 1 of the present invention depicts prospectively a golfer in set up position with the elastic bands attached to a golf club and looped around the lower neck.

As with FIG. 1 of the present invention a right handed golfer (10) is in set up position with an elastic band (3) composed of flat elastic resistance training exercise band attached to a golf club (9) and looped around the back lower neck nearest upper spine while resting on the right (1) and left (2) shoulders. For a right hand golfer, the intended use but not limited to, the right hand of the elastic loop (3) donned over the right shoulder (1) correlates with the right hand (6) grasp location on the golf club grip (8). The golfer extends his/her arms to take set up position thus stretching the elastic band to form parallelism view points between both right (4) and left (5) arms and the elastic band (3).

The golfer is now ready to take swing, drill check, or full unrestricted swing with or without a golf ball. During the swing, the golfer (10) will diagnose swing mechanics compared to the elastic band (3) i.e. if the elastic band (3) tension decreases at critical points in the swing, then a collapse between the upper spine and the hands took place, commonly the left or right elbow. The arm muscles will feel this collapse and help diagnose where failure took place in the swing. The golfer (10) can then take intermediate drill swings to visualize the comparison of the elastic band (3) parallel to the right (4) and left (5) arms to both see and feel for the corrections of the previous swing.

Flat elastic resistance bands were chosen as to provide comfort to the user, flexibility in methods of use, and flexibility in the manufacturing of the present invention. Flat elastic resistance bands are widely used in the fitness and exercise industry because of their durability, flexibility of use, and non friction surfaces.

Figure 2:
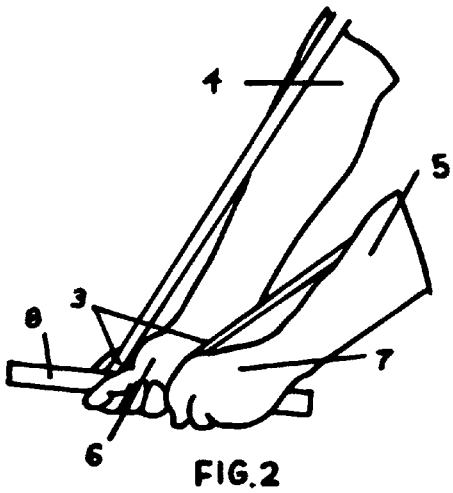
FIG. 2 of the present invention depicts prospectively an exploded view of a golfer's hands, swing position "halfway-back," and elastic band distal end locations.

An exploded view of the present invention in use by a right hand golfer FIG. 2 shows the elastic band (3) properly positioned between the thumb and forefinger of the right hand (6) and properly positioned between the thumb and forefinger of the left hand (7) with the elastic band (3) attached to a golf club (9) and the golfers swing at "halfway-back" position or hinge point position.

Figure 3:
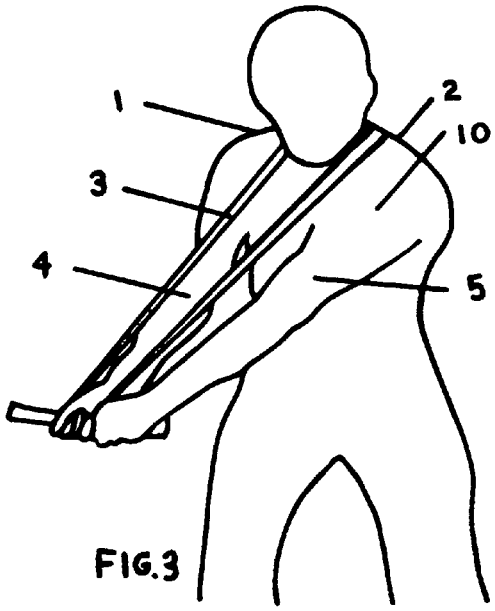
FIG. 3 of the present invention depicts prospectively a golfer swing "halfway-back" with the elastic band looped around the lower neck and over both shoulders.

FIG. 3 of the present invention shows a golfer (10) in the "halfway-back" swing position with the elastic band (3) looped around the lower neck and resting on both the right and left shoulders (1) and (2) respectively. With the elastic band (3) looped around the lower neck nearest the upper spine, the present invention provides the golfer with excellent resistance feedback and unmatched golf club stability as the golf club (9) rotates on plane around the spine.

Figure 4:
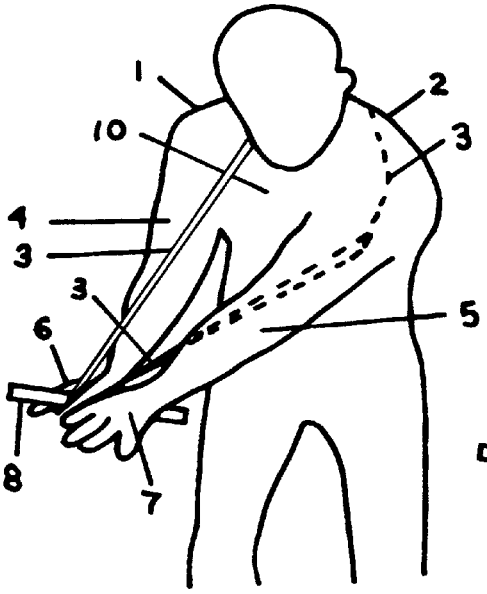
FIG. 4 of the present invention depicts prospectively a golfer swing "halfway-back" with the elastic band looped over the right shoulder and under the left arm pit. Golf club stays in "halfway-back" position with open hands in any represented band location.

FIG. 4 of the present invention shows a golfer in the "halfway-back" position or hinge position with the elastic band (3) around the lower back neck and resting on the right shoulder (1) and the elastic band (3) is positioned under the left arm (5) pit which then runs parallel with the inside left arm (5). With this elastic band (3) position, the golfer (10) can focus on the left arm (5) position through out the swing and compare his/her left arm (5) with the elastic band (3) flex, i.e., if the left elbow bends, the elastic band (3) will send resistance force loss to the left arm (5). Again, the golfer (10) can then take drill stroke swings to visualize the comparison of the elastic band (3) parallel to the right (4) and (5) left arms to both see and feel for the corrections of the previous swing.

In addition, FIG. 4 displays a golfer in the "halfway-back" position or hinge position with the golfers right hand (6) and the left hand (7) wide open. The upwardly projected resistance forces of the elastic band (3) are vectored through the arms and directly toward the loop around the lower back neck/upper spine which is then translated to the distal ends connected to the golf club (9), right hand (6) between thumb and forefinger, left hand (7) between thumb and forefinger, which forms a balanced connection between the golfer and the present invention. This shows that the resistance forces are in perfect plane with the golfer (10). For example, with the present invention, a golfer (10) can swing to any intermediate check point in the swing, stop, open his/her hands and the golf club (9) will stay in position without fingers grasping. This is proof that the forces are positioned most efficiently throughout the present invention thus will provide the utmost stability and reliability. For contrast, imagine if the connection point of the elastic band (3) to the golf club (9) was at the butt end of the golf club handle, the forces would be pulling up on the handle and pushing the golf club head into the ground. The golfer (10) would then be confused by the off plane forces distracting him/her from focusing on what is needed.

Figure 5:
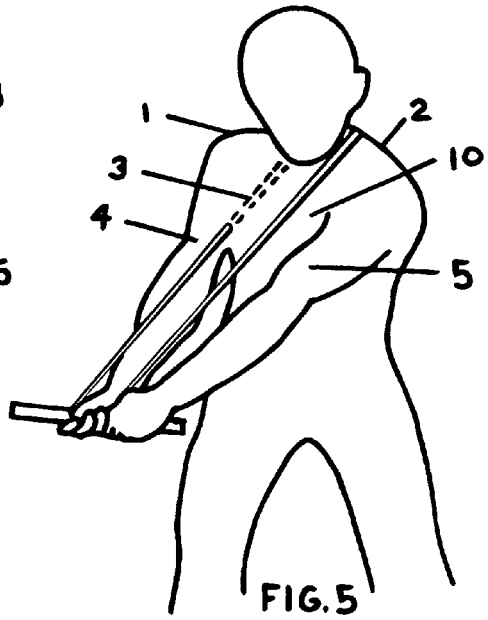
FIG. 5 of the present invention depicts prospectively a golfer swing "halfway-back" with the elastic band looped over the left shoulder and under the right arm pit.

FIG. 5 of the present invention shows a golfer in the "halfway-back" position or hinge position with the elastic band (3) around the lower back of neck and resting on the left shoulder (2) and the elastic band (3) is positioned under the right arm (4) pit which then runs parallel with the inside right arm (4). With this elastic band (3) position, the golfer (10) can focus on the right arm (4) position through out the swing and compare his/her right arm (4) with the elastic band flex, i.e., if the right elbow bends, the elastic band (3) will send resistance force loss predominantly through the right arm (4). Again, the golfer (10) can then take intermediate stroke swings to visualize the comparison of the elastic band (3) parallel to the right arm (4) and (5) left arm to both see and feel for the corrections of the previous swing. The resistance forces are positioned most efficiently throughout the present invention with all lower neck/upper spine combinations of the elastic band (3) loop and will provide the utmost stability and reliability.

Figure 6:
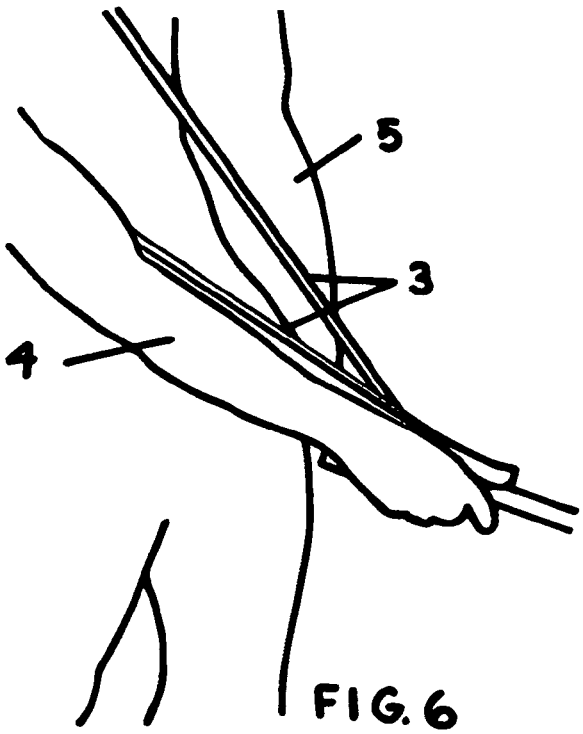
FIG. 6 of the present invention depicts prospectively a golfer swing ¾ follow-through stage of a golf swing.

FIG. 6 of the present invention shows a golfer (10) in the ¾ follow-through stage of a golf swing. Again, the elastic band (3) will remain straight and in parallel reference with both the right (4) and left (5) arms.

Figure 7:
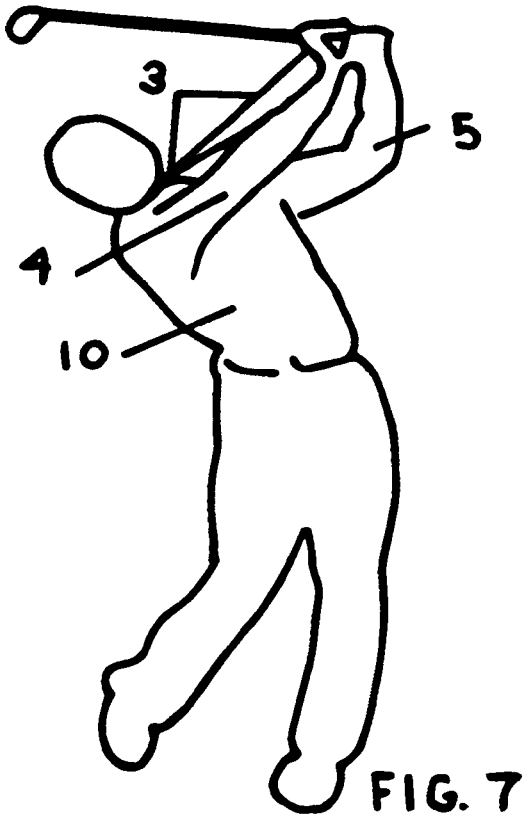
FIG. 7 of the present invention depicts prospectively a golfer in the full follow-through stage of a golf swing FIG. 8A of the present invention depicts prospectively a standard golf grip component.

FIG. 7 of the present invention shows a golfer (10) in the full follow-through stage of a golf swing. Again, the elastic band (3) will remain straight and in parallel reference with the right arm (4) but the left arm (5) on a right hand golfer will relax slightly as the left arm (5) elbow bends to complete the typical golf swing. A golfer can use the present invention to check the final position easily via resistance and visual elastic band (3) as the ball is already hit and the golf club (9) is at rest.

Figure 8A:
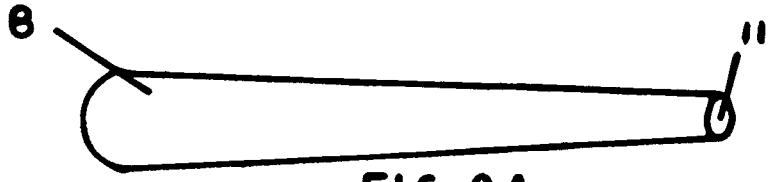
FIG. 8B of the present invention depicts prospectively a standard golf grip component with two longitudinal perimeter holes.
FIG. 8C of the present invention depicts prospectively a standard golf grip component with a hole punch back stop inserted.
FIG. 8D of the present invention depicts prospectively an assembled golf grip with an elastic band installed onto a golf club shaft, band untrimmed.
FIG. 8E of the present invention depicts prospectively an assembled and installed golf grip with a double sided tape band connector and a band loop for band length adjustment.

FIG. 8A of the present invention depicts a standard rubber golf club grip (8) with a bore hole (11) for inserting onto a golf club shaft.

Figure 8B:
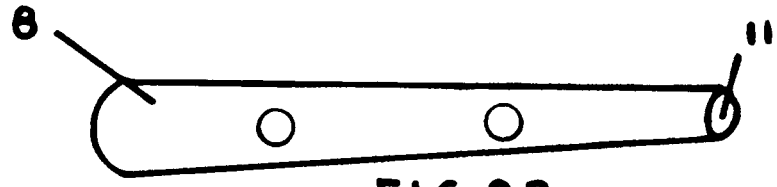

FIG. 8B of the present invention depicts a standard rubber golf club grip (8) with small punched holes (12) and (13) that go only through one surface of the golf grip (8) and preferably longitudinal linier with the golf grip manufacture label facing up. Typical install of a golf grip is with the label up and in line with the golf club head leading edge of the blade.

The small holes shown in FIG. 8B (12) and (13) are 3/16 inches in diameter and positioned (for a medium to large size hand) 3¾ inches from the butt end of the golf club grip (8), first hole (12), and 6¼ inches from the butt end of the golf grip (8), second hole (13). The aforementioned hole location distances are set as base and flexible to change dependant upon the hand size of the golfer (10). The hole size is also base and can change dependant upon elastic band (3) size.

The small holes (12) and (13) in the golf grip (8) are designed to receive the distal ends of the elastic band (3). For assembly purpose, we will call golf grip small hole (12) the butt proximal hole and for small hole (13) the bore (11) proximal hole.

Figure 8C:
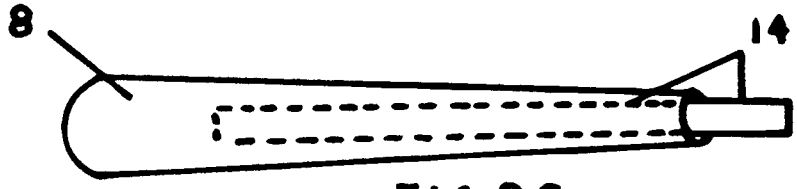

FIG. 8C of the present invention depicts a standard rubber golf club grip (8) with a wooden trim piece (12"×¾"×¼") punch back stop (14) inserted into the bore (11) end of the rubber golf grip approximately 8" deep. The punch back stop (14) will serve as a back stop for using a 3/16" punch to install the two small holes (12) and (13) into the rubber golf grip (8).

Figure 8D:
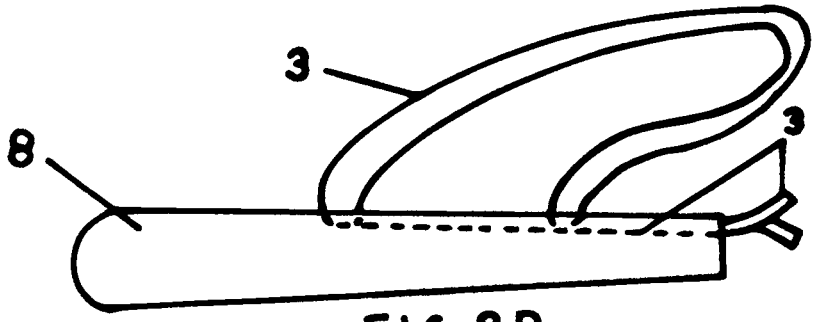

FIG. 8D of the present invention depicts a standard rubber golf club grip (8) with an elastic band (3) installed into the rubber golf club grip (8). The two distal ends of the elastic band (3) are inserted one at a time into the small holes (12) and (13) with the first end into proximal hole (12) and extends through the bore (11) end by approximately 2". The second distal end of the elastic band (3) is inserted into the proximal hole (13) and extends through the bore (11) end by approximately 2". The length of the elastic band (3) loop can now be set by pulling one or both of the elastic band distal ends through the bore (11).

The length of the elastic band (3) loop is adjusted per the golfers' outstretched arm and fingers held horizontal to the ground and measured from the middle of either thumb to the side of either neck at shoulder height. For example, if you choose the right arm (4), measure from the right side of the neck along the outstretched right arm horizontal to the ground to the middle of the outstretched right thumb. This measurement will correlate with distance between the extended, but not stretched, elastic band (3) loop and the golf club grip (8) at the point between the two small holes (12) and (13).

By using this measurement, the width of the golfers' neck is the elastic stretch incorporated into the elastic band (3) when the golfer (10) takes address with the golf club (9). Once the elastic band (3) length is determined, the excess elastic band (3) extending past the bore (11) can be trimmed. The elastic band (3) distal ends extending out of the golf club grip (8) bore (11) should be trimmed back by ½" so that the bore end of the golf grip (8) will cover the elastic band (3) distal ends. See FIG. 8E.

Figure 8E:
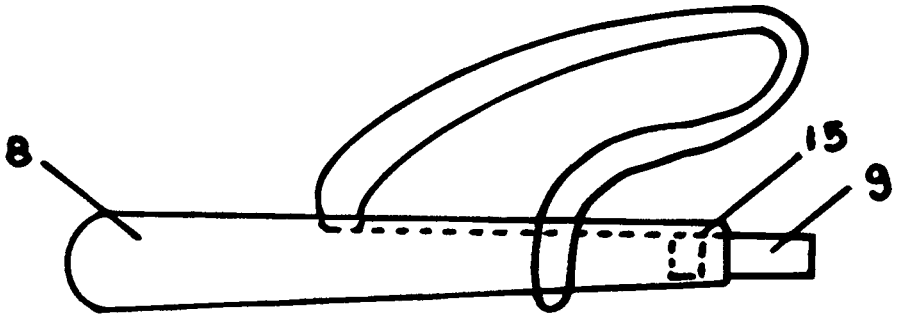

FIG. 8E of the present invention depicts a standard rubber golf club grip (8) with an assembled elastic band (3). Double sided tape (15) used in the golf industry to install golf grips can be used to secure the elastic band (3) distal ends. FIG. 8E also shows the elastic band (3) looped around the golf club grip (8) at small hole position (13) as an adjustment for the elastic band (3) length if desired.

Several combinations of the elastic band (3) looped around the golf club grip (8) will produce numerous different effects. For instance, if a golfer (10) wanted to practice the feel of the golf club (9) head turning over or closing at impact, he/she could wrap the elastic band as shown in FIG. 8E around the golf club grip (8). The elastic band (3) will produce a turning tension in the right hand (6) giving the golfer (10) a muscle memory feedback motion of rotating the golf club head closed at impact.

Figure 9:
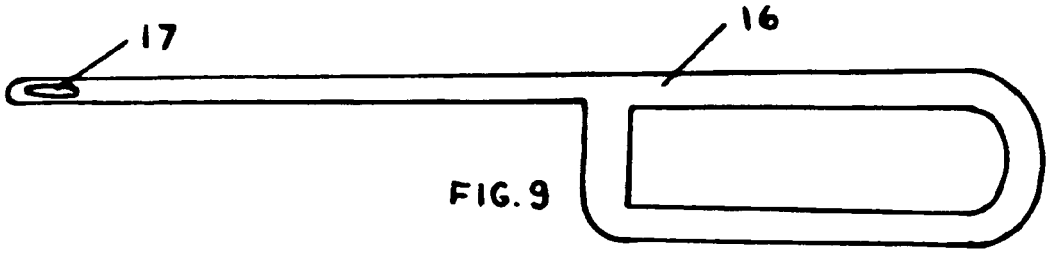
FIG. 9 of the present invention depicts prospectively a tool for assembly of an elastic band to a component grip with holes.

FIG. 9 of the present invention shows the elastic band (3) install tool (16). The elastic band (3) install tool (16) is used to install the elastic band (3) into the small holes FIG. 8B (12) and (13) on the golf club grip with holes. First, thread one distal end of the elastic band (3) through the tool hole (17) and push it through the small hole (12) then through the bore (11) end of the golf club grip. Second, thread the remaining distal end of the elastic band (3) through the tool hole (17) and repeat the previous step. To help with installing the elastic band (3) through the small holes (12) and (13), one can use a small amount of soapy water. Clean thoroughly afterwards with a cloth.

Figure 10:
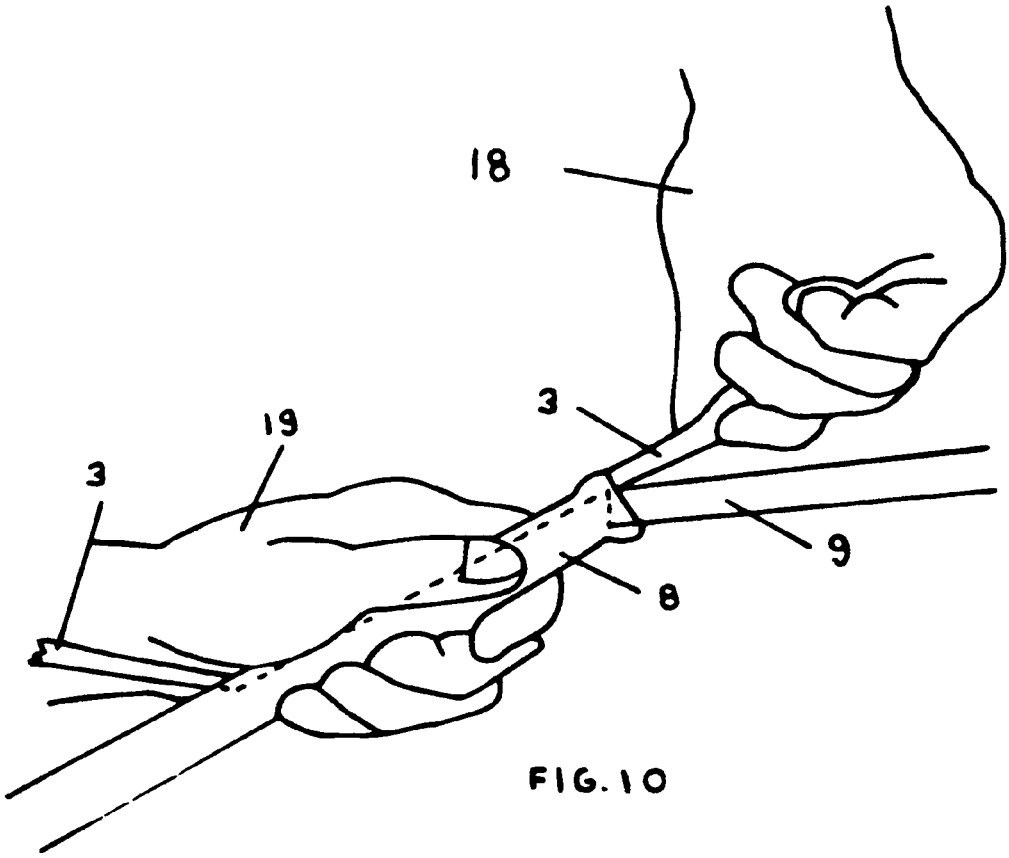
FIG. 10 of the present invention depicts prospectively the install of an assembled golf grip with an elastic band untrimmed.

FIG. 10 of the present invention shows an exploded view a golf club makers hands (18) and (19) right and left respectively installing an assembled golf grip FIG. 8D onto a golf club shaft (9) butt end.

First, prepare the golf club shaft as would a golf club maker by installing double sided golf club grip tape onto the butt end of the golf shaft. Apply a small amount of solvent into the golf club grip (8) through the bore (11) end and onto the prepared golf club shaft over the grip tape. Hold the distal ends of the elastic band (3) in the right hand (18). Position the elastic band (3) ends upward and above the golf club shaft butt end with the right hand (18). Hold the assembled golf grip (8) FIG. 8D with the left hand (19) and guide the bore (11) end of the golf club grip (8) onto the butt end of the golf shaft while holding the golf club grip (8) at approximately 20 degrees of horizontal. Pull slightly with the right hand (18) the elastic band (3) ends at the same time pushing with the left hand (19) the golf club grip (8) onto the golf club shaft while keeping the elastic band (3) on top relative the golf club shaft. Install the golf club grip (8) all the way on until the butt end of the golf grip (8) stops at the butt end of the golf club (9) shaft. Align the golf club grip (8) as needed to ensure that the elastic band (3) is aligned up with the golf club head blade leading edge, as per typical club making process of installing golf component grips. Clean thoroughly with a cloth the golf club grip (8) and elastic band (3) of excess solvent. Lean the present invention against a wall or back board with the grip end up in room temperature and let cure for approximately 8 hours before use.

The present invention sets itself apart from other golf swing training devices because it addresses with simplicity the most common mistakes made in the complexity of a golf swing. "Chicken Winging" is where the left elbow collapses during the down swing follow-through leaving the club face wide open for slices, chunks, topping the ball, etc. It's visible at post ball impact where the left arm disconnects from the left side rib cage area with the left elbow pointing down the target line when it should be rotating around the body turn. The present invention will capture this visually and mechanically. Visually, the elastic band is no longer parallel with the left arm forming a gap between the two. Mechanically, the elastic band will send feedback through the left arm in the form of resistance force loss.

The dreadful "flying right elbow" is where the right elbow disconnects from the right side rib cage area pointing upward and back during the backswing. Again, this causes major failure to produce good results in the sport. The present invention addresses this by visual and mechanical aid. Visually, during a "flying right elbow" the elastic band will no longer run parallel to the right arm forming a V-shape but rather form a rectangle leaving a noticeable gap between the elastic band and the right arm. Mechanically, again, resistance force will be lost during the collapse of the right elbow sending feedback through the right arm.

The present invention incorporates strategically placed connection points; the golfer is joined with the golf club in the most efficient use of forces and natural feeling of proper position with out restrictive devises. These balanced forces coordinate and guide the golfer unrestricted through the desired swing plane from the beginning of the swing set up to the end of the full swing follow through. The connection is evident when a golfer uses the present invention for drill swing check points by stopping the swing and holding the position with his/her hands wide open and the golf club will stay in that position.

Setting the "halfway-back" position is one of the most import parts of the golf swing because it sets the stage for the rest of the golf swing outcome. The present invention was originally design for this purpose and works well. As Nick Faldo pointed out "The beauty of working on this halfway-back position is that all the details of a technically sound swing are encapsulated within it: you have a full wrist hinge, the club is swinging up on plane, and you maintain good body angles. Completing your shoulder turn gets you to the top, whereupon unwinding the body invites the hands and arms into the perfect hitting position" (Faldo).

The present invention has no over-whelming fixtures that get in the way so the golfer can focus on the muscle feedback and visual aids that can be transferred to the golf course under pressure situations. It produces the most natural realistic feeling of a golf club because the contact points are kept intact to resemble as much as possible a typical golf club.

The present invention re-enforces the correct changes, all desired changes through out the entire swing as apposed to most devices that focus on one or two aspects. It allows you to repeat simultaneously good memory habits subconsciously. Changes are easily noticed to ensure what is practiced is reliable. The golfer takes ownership of his/her swing with confidence apposed to someone watching and providing feedback that may not be useful or even comprehendible.

Self diagnosing good swing habits from bad ones is one of the most difficult challenges in golf. Who hasn't walked away from a bad shot and said "what am I do wrong?" Most golfers don't have the knowledge to differentiate good from bad swing mechanics. The present invention golf swing training device makes it simple; during the swing, visually ensure that the arms parallel the elastic band while keeping resistance between the connection points. If resistance is lost at any point in the swing, note the location and run drills on that point, most likely a collapse in the elbows.

The doctrine herein the present invention reflect examples, drawings, advice, claims and "best mode contemplated" to facilitate comprehension by those possessing skills in the art of golf. Embodiments of the present invention are subject to change within the scope of the claims.

What is claimed is:

1. A golf swing training device comprising: a grip common to a golf grip with a first small perimeter through-hole located midway lengthwise and a second small perimeter through-hole located a distance, depending on a golfer's hand size, midway lengthwise and linear from the first small perimeter through-hole, a flat elastic band sized for resilience and made to couple with the grip, a club common to a golf club made to couple conjointly with the flat elastic band and said grip, these conjoined components including the grip, the flat elastic band, and the club make up the golf swing training device and form a resilient loop that's donned over a golfer's head while grasping the grip with both hands and taking normal golf address posture; elongation of the flat elastic band lengths along the golfer's inside out-stretched arms creates balanced resistance forces between the flat elastic band connection points and the golfer's body interface that mechanically assists and simulates proper golf club positions and golf swing during grasp, take-away, hinge point, and full-swing follow-through; wherein said golf grip has a large end that tapers to a narrow end and a bore hole; the first small perimeter through-hole sized to receive a first rolled end of said flat elastic band; the first small perimeter though-hole is located midway lengthwise on the grip relative to a golfer's thumb and index finger; the second small perimeter through-hole sized to receive a second opposite rolled end of said flat elastic band, the second small perimeter through-hole is located at a midway distance lengthwise depending on a golfer's hand size from the first small perimeter through-hole and during using the device the holes and section of the elastic band are positioned between the golfer's thumb and index finger.

* * * * *